US012447390B2

(12) United States Patent
Yen et al.

(10) Patent No.: US 12,447,390 B2
(45) Date of Patent: Oct. 21, 2025

(54) INTELLIGENT SCORING METHOD FOR MARTIAL ART CONTESTS AND SCORING DEVICE AND SYSTEM THEREOF

(71) Applicant: BAOJUN ZHIYUN CO., LTD., Taipei (TW)

(72) Inventors: Chia Chun Yen, Taichung (TW); Pao Hsien Kuo, Taipei (TW)

(73) Assignee: Baojun Zhiyun Co., Ltd., Taipei (TW)

( * ) Notice: Subject to any disclaimer, the term of this patent is extended or adjusted under 35 U.S.C. 154(b) by 309 days.

(21) Appl. No.: 18/179,497

(22) Filed: Mar. 7, 2023

(65) Prior Publication Data

US 2024/0226701 A1 Jul. 11, 2024

(30) Foreign Application Priority Data

Jan. 6, 2023 (TW) ..... 112100652
Jan. 6, 2023 (TW) ..... 112100653

(51) Int. Cl.
*A63B 71/06* (2006.01)

(52) U.S. Cl.
CPC ..... *A63B 71/0605* (2013.01); *A63B 71/0622* (2013.01); *A63B 2220/05* (2013.01); *A63B 2220/836* (2013.01); *A63B 2225/50* (2013.01); *A63B 2244/10* (2013.01)

(58) Field of Classification Search
CPC ..... A63B 1/0622; A63B 2220/836; A63B 2244/10
See application file for complete search history.

(56) References Cited

U.S. PATENT DOCUMENTS

| | | | | |
|---|---|---|---|---|
| 4,763,284 | A * | 8/1988 | Carlin | A63B 69/00 482/84 |
| 7,819,742 | B2 * | 10/2010 | Chamberlain | G07G 5/00 463/16 |
| 9,713,764 | B2 * | 7/2017 | Minkovitch | A63F 13/812 |
| 10,143,888 | B2 * | 12/2018 | Andrews | H04W 4/02 |
| 10,441,848 | B1 * | 10/2019 | Skhisov | G06F 3/0304 |
| 11,478,681 | B2 * | 10/2022 | Kantorovich | G06N 20/00 |
| 2005/0162257 | A1 * | 7/2005 | Gonzalez | A63B 24/0021 377/5 |
| 2010/0144414 | A1 * | 6/2010 | Edis | A63F 13/816 482/8 |
| 2017/0134712 | A1 * | 5/2017 | Remer | A63C 19/005 |
| 2022/0080286 | A1 * | 3/2022 | Chau | A63B 71/0669 |
| 2022/0323847 | A1 * | 10/2022 | Lee | H04N 21/81 |

* cited by examiner

*Primary Examiner* — James S. McClellan
(74) *Attorney, Agent, or Firm* — Rosenberg, Klein & Lee

(57) ABSTRACT

An intelligent scoring method, device, and/or system for martial art contests produces intelligent scoring and is applicable to polearm, western fencing, martial art, wrestling, taekwondo or spearing fight contests. These allow both competing parties in the martial art contest to use a weapon or to wear a protective gear that is equipped with a sensor. When these two sensors detect a contestant in the contest being hit, the sensors and a plurality of image capturing devices are set to transmit data of the hit to a tournament judging program device at the fighting ring via wireless communication, which then uploads the data to a cloud device for score recommendations. Next, the cloud device transmits the score recommendations to the tournament judging program device to be confirmed by the referee as the score, which is uploaded back to the cloud device for real-time inquiry by audience or contestants.

8 Claims, 11 Drawing Sheets

413

| Round | AI_CCTV ( NO. ) | Color red party ( Recommended score ) | truck body area hit by Color red party $m^2$ | Color blue party ( Recommended score ) | truck body area hit by Color blue party $m^2$ | mp4 | Color red party ( actual score ) | Color blue party ( actual score ) |
|---|---|---|---|---|---|---|---|---|
| 1 | 1 | 3 | 1.2 | 0 | 1 | | 3 | 0 |
| 1 | 2 | NULL | NULL | 0 | NULL | | 3 | 0 |
| 1 | 3 | 3 | 0.4 | 0 | 0.9 | | 3 | 0 |
| 1 | 4 | NULL | NULL | NULL | NULL | | 3 | 0 |
| 1 | 5 | NULL | NULL | NULL | NULL | | 3 | 0 |
| 1 | 6 | 3 | 0.6 | NULL | NULL | | 3 | 0 |
| 1 | 7 | NULL | NULL | NULL | NULL | | 3 | 0 |
| 1 | 8 | NULL | NULL | NULL | NULL | | 3 | 0 |

FIG.7

| AI_CCTV (NO.) | Color red party (Recommended score) | truck body area hit by Color red party $m^2$ | Color blue party (Recommended score) | truck body area hit by Color blue party $m^2$ | mp4 |
|---|---|---|---|---|---|
| 1 | 3 | 1.2 | 0 | 1 | |
| 2 | NULL | NULL | 0 | NULL | |
| 3 | 3 | 0.4 | 0 | 0.9 | |
| 4 | NULL | NULL | NULL | NULL | |
| 5 | NULL | NULL | NULL | NULL | |
| 6 | 3 | 0.6 | NULL | NULL | |
| 7 | NULL | NULL | NULL | NULL | |
| 8 | NULL | NULL | NULL | NULL | |

INTELLIGENT SCORING METHOD FOR MARTIAL ART CONTESTS AND SCORING DEVICE AND SYSTEM THEREOF

BACKGROUND OF THE INVENTION

1. Fields of the Invention

The present invention relates to the domain of intelligent scoring for contests, especially, the technical scope of an intelligent scoring method for martial art contests and the scoring device and system thereof.

2. Descriptions of Related Art

Martial art matches include sport categories of fighting with weapons or bare hands. The goal of a contest is to gain more points than the opponent to win over the opponent, or to knock down the opponent and end the contest. At the same time, contestants must dodge attacks by the opponent in order to maintain one's combat capability.

A score is evaluated and determined comprehensively by which hit location of the body is struck and the strength of the strike. For martial art contests these days, the score of a contestant must be reviewed comprehensively by at least one referee. Nevertheless, having multiple contests and contestants to complete at the same time, it is difficult to maintain an overall scoring operation and real-time information of competing status of every contest due to different rings and separate scoring operations. Therefore, improvements of the conventional scoring methods of martial art contests are necessary.

SUMMARY OF THE INVENTION

Therefore, in view of the problems existing in the scoring operation of martial art contests, authors of the present invention develop an intelligent scoring method for martial art contests and the scoring device and system thereof. The main objective of the present invention is to provide an intelligent scoring method for martial art contests and the scoring device and system thereof that can accurately determine the score and create a score efficiently. The secondary objective of the present invention is to provide an intelligent scoring method for martial art contests and the scoring device and system thereof that allows real-time inquiries of scores of contestants.

In order to achieve the aforementioned objectives, the intelligent scoring method for martial art contests of the present invention applies the following technical means: an intelligent scoring device for martial art contests, comprising an electronic device that has mobile communication with an internet access function and can be connected to a cloud-based intelligent scoring system, having an application software pre-installed in a memory unit therein, wherein the application software is executed by a microprocessor unit therein and the result is output to a display unit; and a graphical interface that appears on the display unit and provides a graphical interface for referees to operate, wherein the graphical interface displays, but not limited to, a hit location and a hitting image of contestants, an actual score, a score recommendation, a score decision in every round of a contest.

The score recommendation in the graphical interface is further divided to an automatic scoring mode and a manual adjustment mode, whereas the score decision is further divided to the actual scores of contestants separately.

The intelligent scoring device for martial art contests further comprises a tournament judging program device, wherein the tournament judging program device has at least one user interface and such at least one user interface provides inputs of the rounds of contestants. The tournament judging program device receives and transmits the hit signals from the at least two sensors, together with the struck body areas derived from images of the hit area, to a cloud device on a real-time basis.

An intelligent scoring method for martial art contests of the present invention that uses the aforementioned scoring device comprises: a step of wearing the martial art contest sensor, wherein two sensors are provided to both contestants to wear separately; a step of detecting a hit in a martial art contest, wherein these two sensors detect a contestant in the contest being hit and the sensor is set to transmit data of the hit action to a tournament judging program device via wireless communication; a step of capturing images of the hit action, wherein a plurality of image capturing devices identify a struck body area derived from images of the hit area instantly that are transmitted to a tournament judging program device through the network on a real-time basis, and then further to be transmitted to a cloud device by the tournament judging program device; a step of conducting the cloud-based intelligent scoring, wherein a score recommendation module installed in the cloud device performs the score recommendations and then the cloud device transmits the score recommendations to the scoring device in the tournament judging program device; a step of confirming the score by the referee, wherein the score recommended by the scoring device in the tournament judging program device will be confirmed by the referee to produce an actual score of this round, and the actual score decided by the referee is transmitted back to the cloud device for inquiry by audience or contestants.

An intelligent scoring system for martial art contests of the present invention is constructed based on the aforementioned intelligent scoring method for martial art contests, which comprises at least two sensors, a plurality of image capturing devices, a tournament judging program device, and a cloud device that are connected with each other by network. The at least two sensors are to be worn by both contestants individually and transmit data of the hit action to a tournament judging program device. The plurality of image capturing devices are installed in the surrounding areas of the fighting ring to capture images of the contestants and identify a struck body area derived from images of the hit area instantly that are transmitted to the tournament judging program device on a real-time basis. The tournament judging program device comprises at least one user interface and such at least one user interface provides inputs of the rounds of contestants; the tournament judging program device receives and transmits the hit signals detected by the at least two sensors, together with images of the hit area and the struck body area, to a cloud device on a real-time basis. The cloud device has a score recommendation module, wherein the score recommendation module produces score recommendations based on the data provided by the tournament judging program device, and transmits the score recommendations to the tournament judging program device to be confirmed by referees afterward, in order to produce the actual score of this round. Finally, the final actual score decided by the referee is transmitted back to the cloud device again.

The score recommendation module of the intelligent scoring system for martial art contests adopts machine learning to obtain a usage model. A dataset and a training model are pre-created; the training model is trained by the dataset to establish an evaluation model. If the evaluation model passes the verification, the evaluation model will become the usage model.

The dataset of the intelligent scoring system for martial art contests has items that include "round" of the contest, "recommended score" and "struck body area" of contestants, "actual score" decided by the referees for storing data.

The intelligent scoring system for martial art contests selects datasets of "round", "recommended score" and "struck body area" of contestants from the data columns as the characteristics to conduct prediction, and the column of "actual score" of the dataset is selected as the label, to train the training model to learn therefrom.

The score recommendation module of the intelligent scoring system for martial art contests is created using a matrix factorization in conjunction with the dataset. In other words, a score matrix is created based on the dataset and input to the matrix factorization to output an explicit data and an implicit data, wherein the explicit data are the actual scores of the contestants.

The tournament judging program device of the intelligent scoring system for martial art contests further comprises a handheld scoring device, wherein the handheld scoring device allows the referee to confirm and monitor the score recommendations of the cloud device.

The at least two sensors of the intelligent scoring system for martial art contests are installed on the weapons or protective gears of both competing parties separately. The intelligent scoring system for martial art contests is applicable to polearm, western fencing, martial art, wrestling, taekwondo or spearing fight contests.

Therefore, the present invention adopts the aforementioned technical means to achieve the following functions:

1. During the martial art contest, the present invention activates a plurality of image capturing devices to record images instantly, and simultaneously uploads signals of the sensors and hitting images to the cloud device. Next, the AI referee (that is the image recognition and scoring module) created in the cloud device performs the score recommendations and the score recommendations are transmitted to the tournament judging program device at the fighting ring for the referee to confirm and monitor. Last, the confirmed actual score is transmitted again back to the cloud device to complete a round of contest. All scores are available for real-time online inquiry by audience or contestants. As a result, the present invention can deliver an automatic scoring operation and increase the efficiency of martial art contests.
2. The AI referee (that is the image recognition and scoring module) created in the cloud device can be monitored by referees on the score recommendations. The more score recommendations are practiced, the more accurate they become. In addition, the present invention uses an edge device to recognize the hit areas of contestants beforehand, and then conducts intelligent scoring in the cloud device, in order to reduce the minimum construction requirement and construction cost of the cloud equipment.
3. All data and information of the martial art contests of the present invention, including rounds, contestants, score recommendations, hitting images and areas thereof are stored in the cloud device. The information not only is available for real-time online inquiry by audience or contestants, but also is used as the dataset for the AI referee to conduct machine learning. The setting is practical and convenient.

BRIEF DESCRIPTION OF THE DRAWINGS

FIG. 7 a schematic diagram of the dataset used by the training model of the score recommendation module of the present invention;

DETAILED DESCRIPTION OF THE PREFERRED EMBODIMENT

Figure 1:
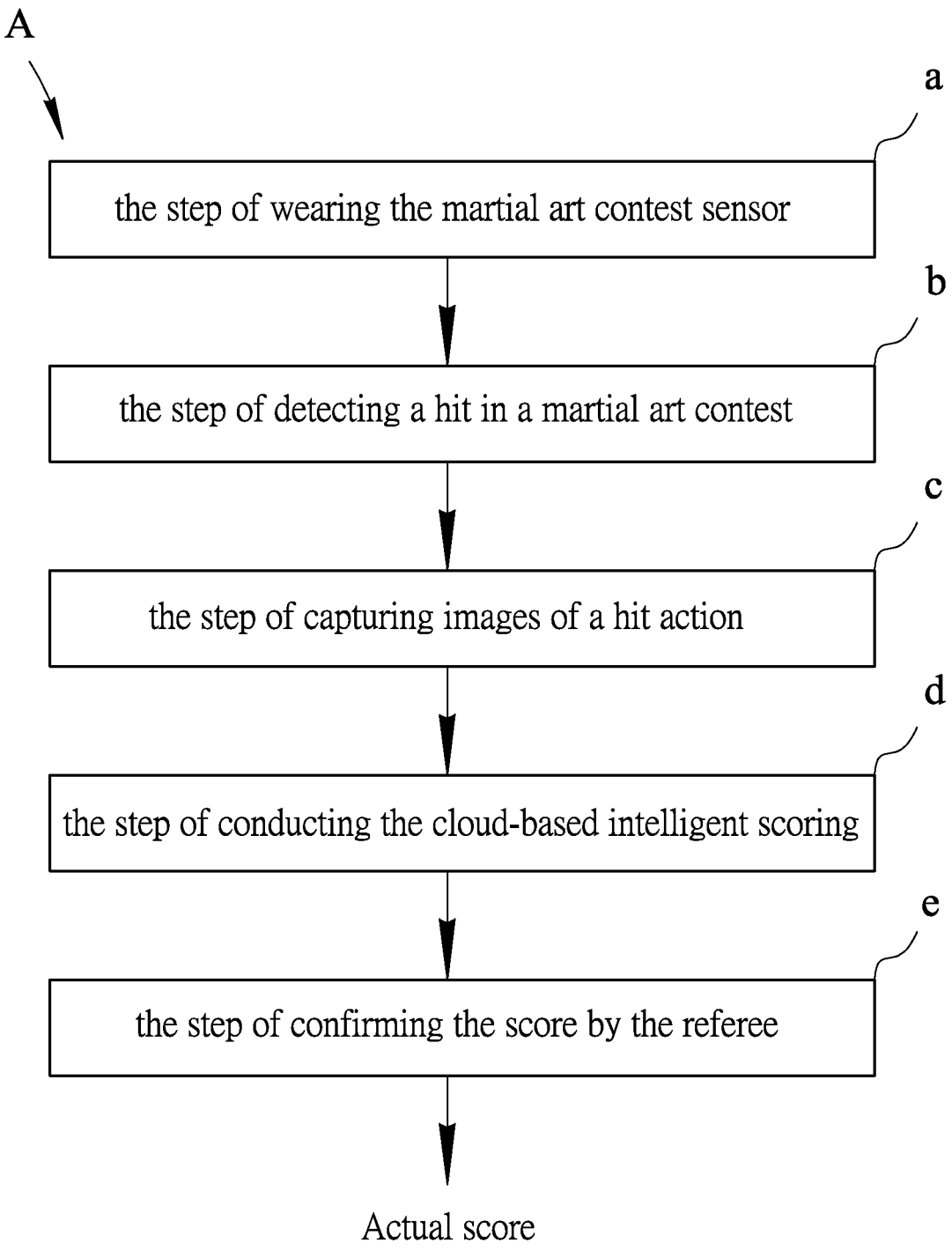
FIG. 1 is a flow chart of steps of the intelligent scoring method for martial art contests of the present invention.

First, please refer to FIG. 1. The present invention relates to an intelligent scoring method for martial art contests and the scoring device and system thereof that can produce intelligent scoring and is applicable to polearm, western fencing, martial art, wrestling, taekwondo or spearing fight contests, wherein the intelligent scoring method for martial art contests A comprises: a step a of wearing the martial art contest sensor, a step b of detecting a hit in a martial art contest, a step c of capturing images of a hit action, a step d of conducting the cloud-based intelligent scoring, and a step e of confirming the score by the referee. Detailed descriptions accompanied by the figures of the present invention are provided as follows.

Figure 2:
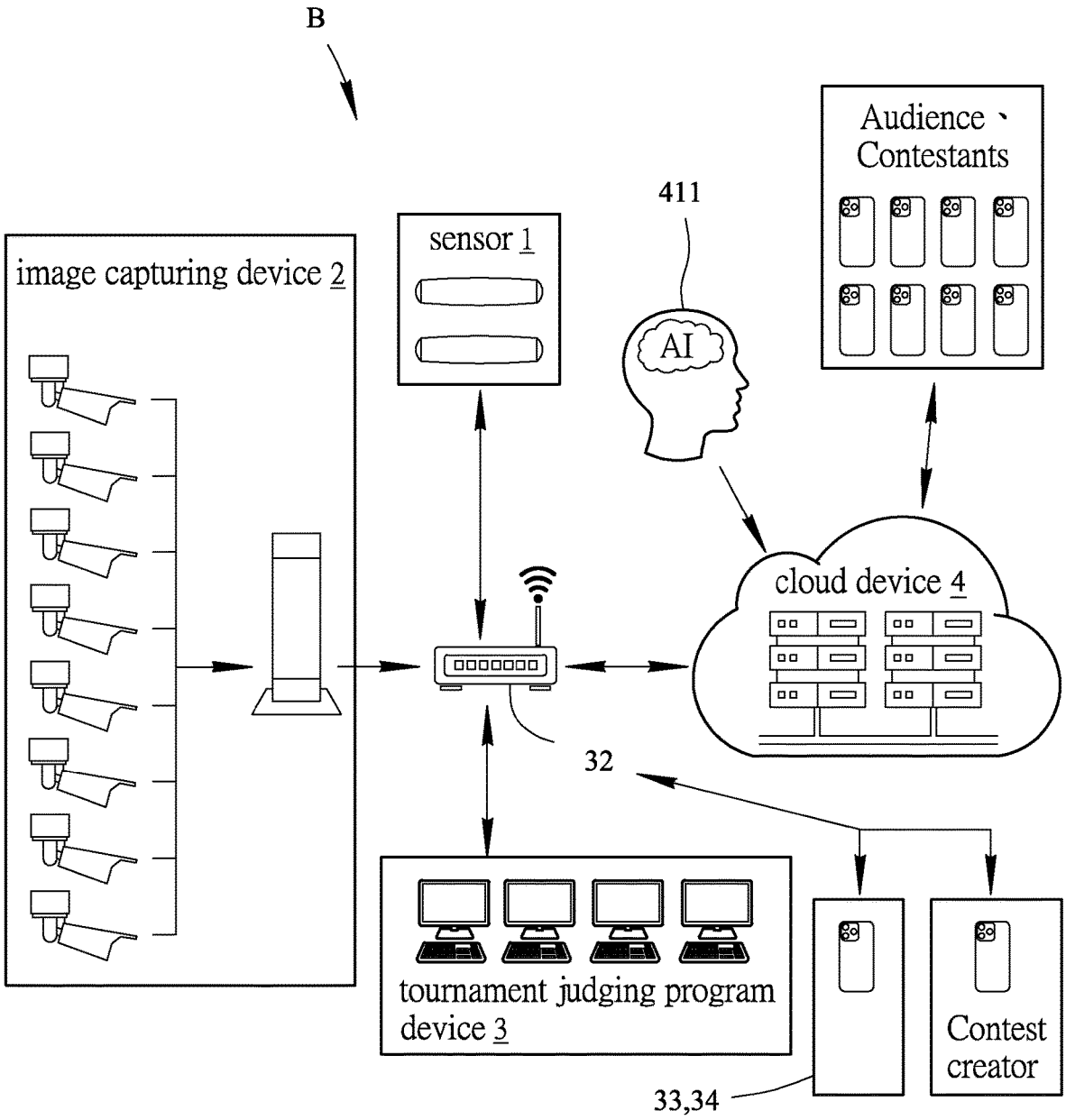
FIG. 2 is a schematic diagram of the architecture of the intelligent scoring system for martial art contests of the present invention.
Figure 3:
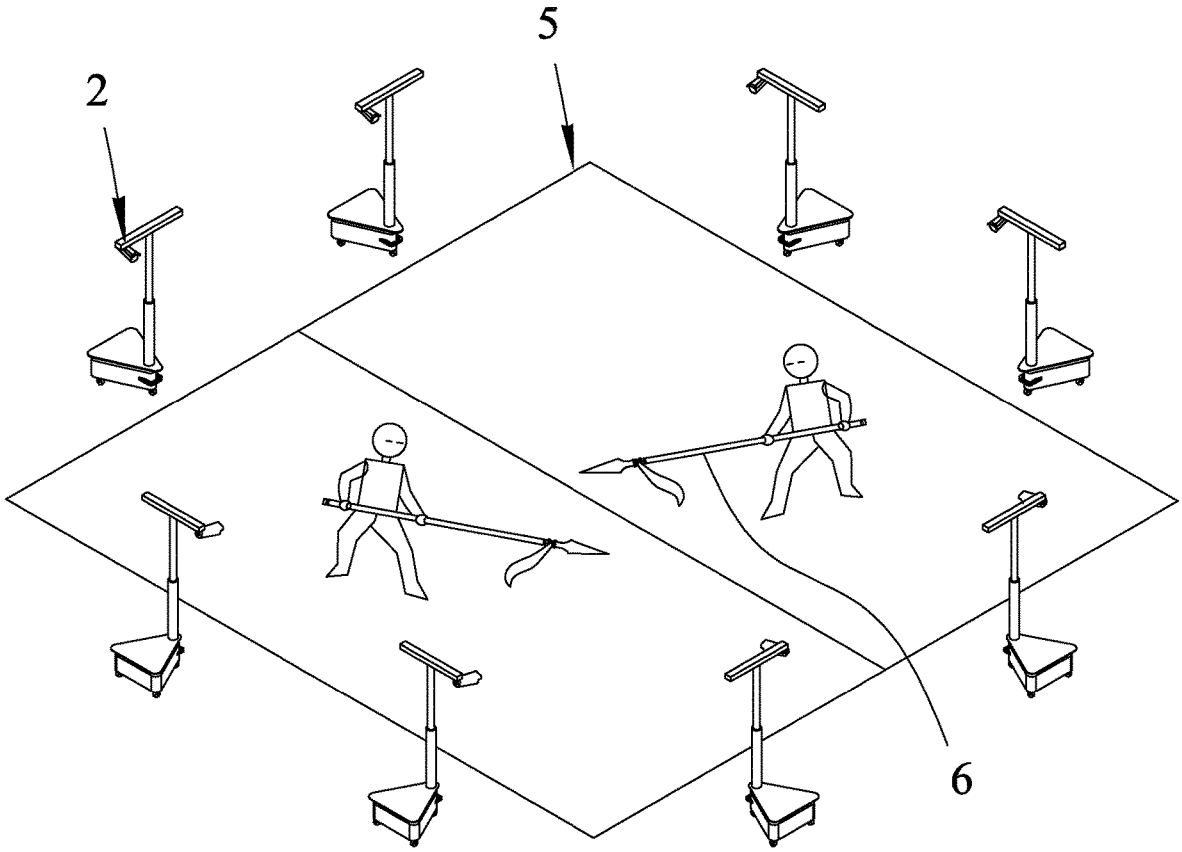
FIG. 3 is schematic diagram of the layout of image capturing devices installed in the surrounding areas of the fighting ring.
Figure 4:
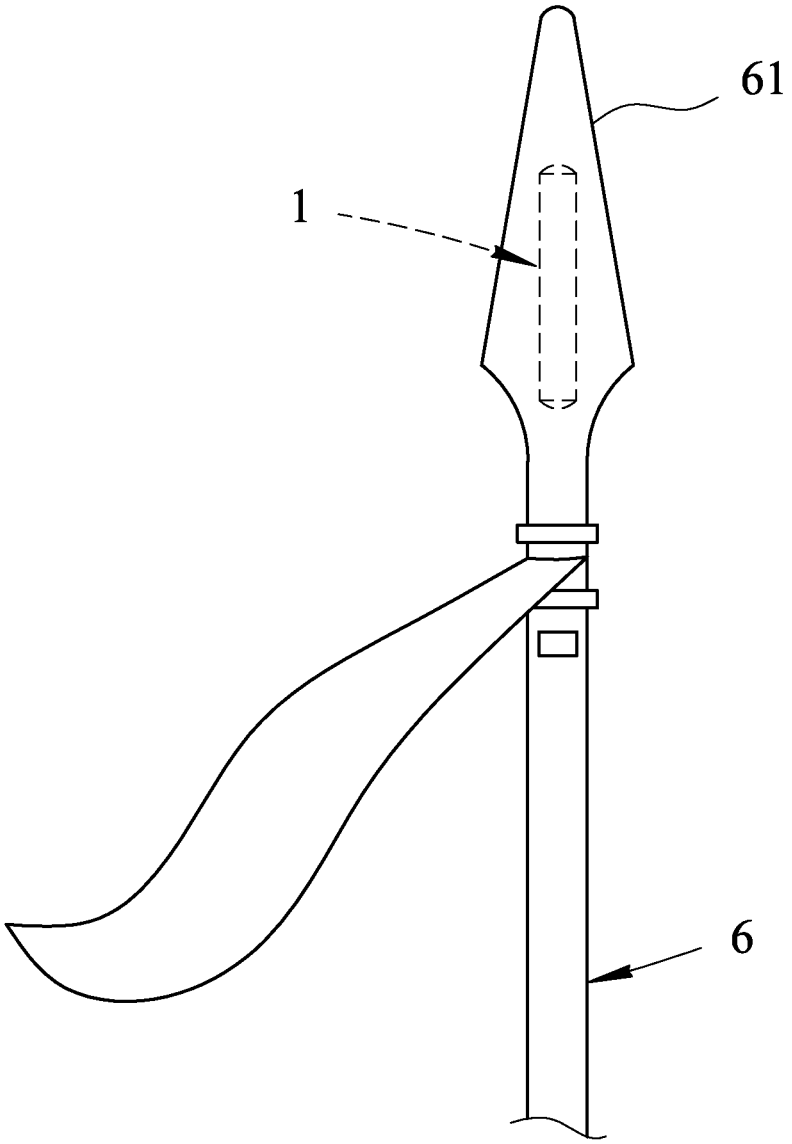
FIG. 4 a schematic diagram of an embodiment of a sensor installed in the polearm head of the present invention.

The step a of wearing the martial art contest sensor, as shown in FIG. 2, provides two sensors 1 for both contestants (represented as the color red and the color blue) to wear. For example, for a martial art polearm contest, as shown in FIG. 3 and FIG. 4, these two sensors 1 are installed separately in the polearm heads 61 located at the front ends of the polearms 6 held by the contestants of color red and color blue individually. In an event of wrestling fighting, these two sensors 1 can be installed separately in the protective gears worn by the contestants. The protective gears can be those having similar designs of Patent No. M276194 of Taiwan, ROC, "Air pressure guard structure against forces of kickboxing with measuring function", which are commonly available in the market and, therefore, will not be further repeated here.

Figure 5:
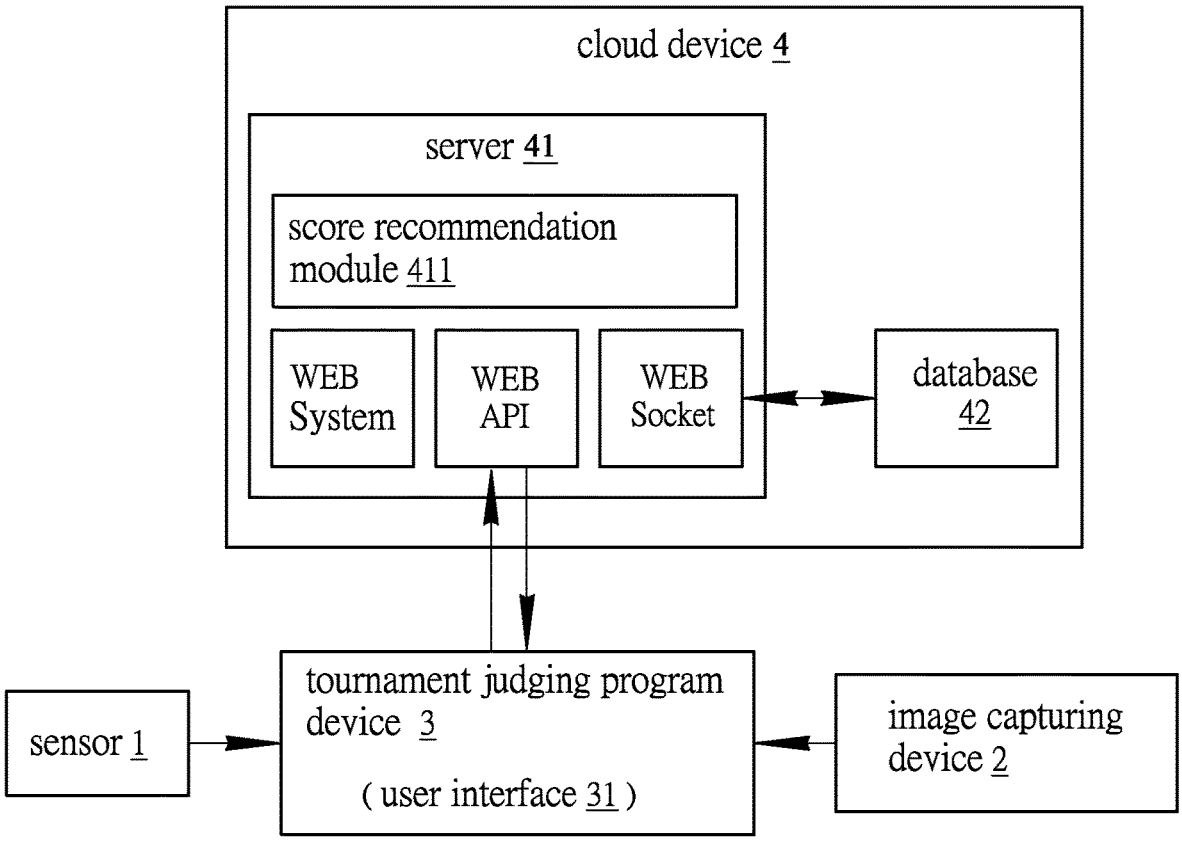
FIG. 5 is a hardware block diagram of the system structure of the present invention.

In the step b of detecting a hit in a martial art contest, when these two sensors 1 detect a contestant in the contest being hit, the sensor 1 is set to transmit data of the hit action to a tournament judging program device 3 via wireless communication, as shown in FIG. 5.

In the step c of capturing images of a hit action, as shown in FIG. 5, a plurality of image capturing devices 2 identify images of the hit area and a struck body area derived therefrom instantly that are transmitted to a tournament judging program device 3 through the WIFI network provided by the router-modem combo 32 on a real-time basis, and then further to be transmitted to a cloud device 4 by the tournament judging program device 3. Furthermore, the plurality of image capturing devices 2 can extract the critical 8 seconds prior to the hit action and transmit the information to the cloud device 4 through the tournament judging program device 3.

Figure 6:
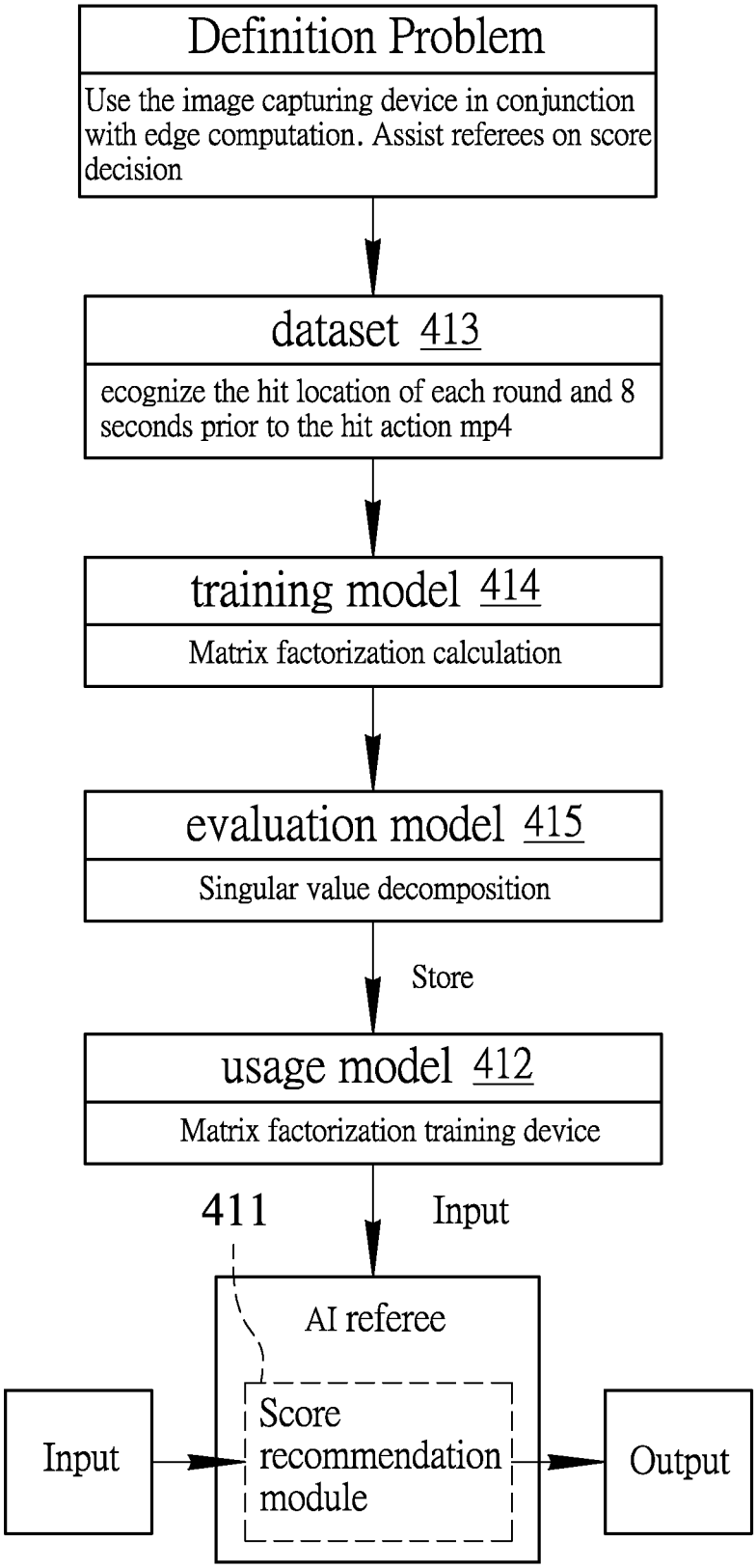
FIG. 6 a flow chart of steps of creating the cloud-based AI referee of the present invention.

In the step d of conducting the cloud-based intelligent scoring, as shown in FIG. 6, a score recommendation module 411 installed in the cloud device 4 performs the score recommendations based on the dataset provided by the tournament judging program device 3. Next, the cloud device 4 transmits the score recommendations to the tournament judging program device 3. Furthermore, the score recommendation module 411 adopts machine learning to obtain a usage model 412. A dataset 413 and a training model 414 are pre-created; the training model 414 is trained by the dataset 413 to establish an evaluation model 415. If the evaluation model 415 passes the verification, the evaluation model 415 will become the usage model 412.

Please refer to FIG. 7. The dataset 413 has items that include "round" of the contest, "recommended score" and "struck body area" of contestants (represented as the color red and the color blue), "actual score" decided by the referees 34 for storing data, wherein the datasets 413 of "round", "recommended score" and "struck body area" of contestants from the data columns as the characteristics to conduct prediction, and the column of "actual score" of the dataset 413 is selected as the label, to train the training model 414 to learn therefrom.

Figure 8:
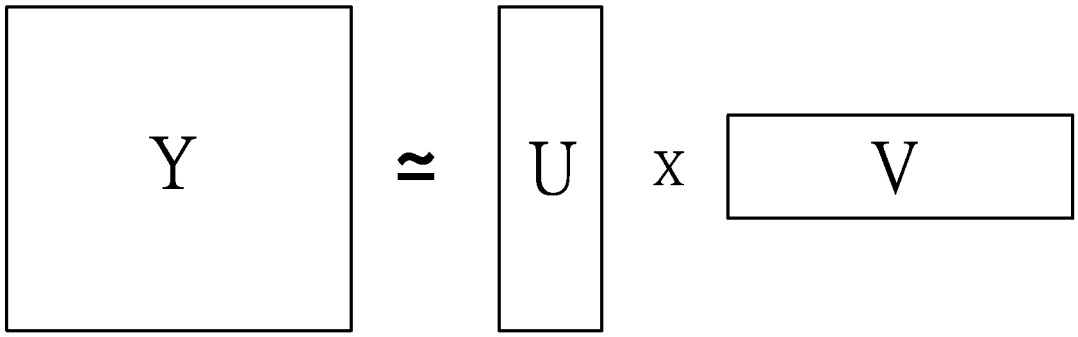
FIG. 8 is a schematic diagram of matrix factorization calculation used by the score recommendation module of the present invention.

Furthermore, the score recommendation module 411 is created using a matrix factorization in conjunction with the dataset 413. Please refer to FIG. 8. An optimal selection is to use the ML.net machine learning framework to create a scoring matrix A that will be input to the matrix factorization calculation to output an explicit data V and an implicit data U, wherein the explicit data V are the actual scores of the contestants. The implicit data U is referred to as the level of interest of users in the item of the dataset, which is reflected in the aforementioned level of behavior of a user toward the items, including round, recommended score of contestants, and struck body area of the contestants.

In the step e of confirming the score by the referee, the score recommended by the tournament judging program device 3 will be confirmed and monitored by the referee 34 to produce an actual score of this round, and the actual score decided by the referee 34 is transmitted back to the cloud device 4 for inquiry by audience or contestants.

The intelligent scoring system for martial art contests B of the present invention is constructed to implement the aforementioned intelligent scoring method for martial art contests A, as shown in FIG. 2 and FIG. 5, which comprises at least two sensors 1, a plurality of image capturing devices 2, a tournament judging program device 3, and a cloud device 4 that are connected with each other by network through a router-modem combo 32. Detailed descriptions accompanied by the figures of the present invention are provided as follows.

The at least two sensors 1 are provided for both contestants (represented as the color red and the color blue) to wear, and are used to transmit the hit signals to the tournament judging program device 3. The at least two sensors 1 are installed separately in the weapons or protective gears used by the contestants. In the embodiment when polearms 6 are used, the sensors 1 are installed in the polearm heads 61 located at the front ends of the polearms separately.

The plurality of image capturing devices 2 are installed in the surrounding areas of the fighting ring 5 to capture images of the contestants and identify images of the hit area and a struck body area instantly that are transmitted to the tournament judging program device 3 on a real-time basis. Furthermore, there are a total of 8 units of the plurality of image capturing devices 2, uniformly installed in the surrounding areas of the fighting ring 5.

Figure 9:
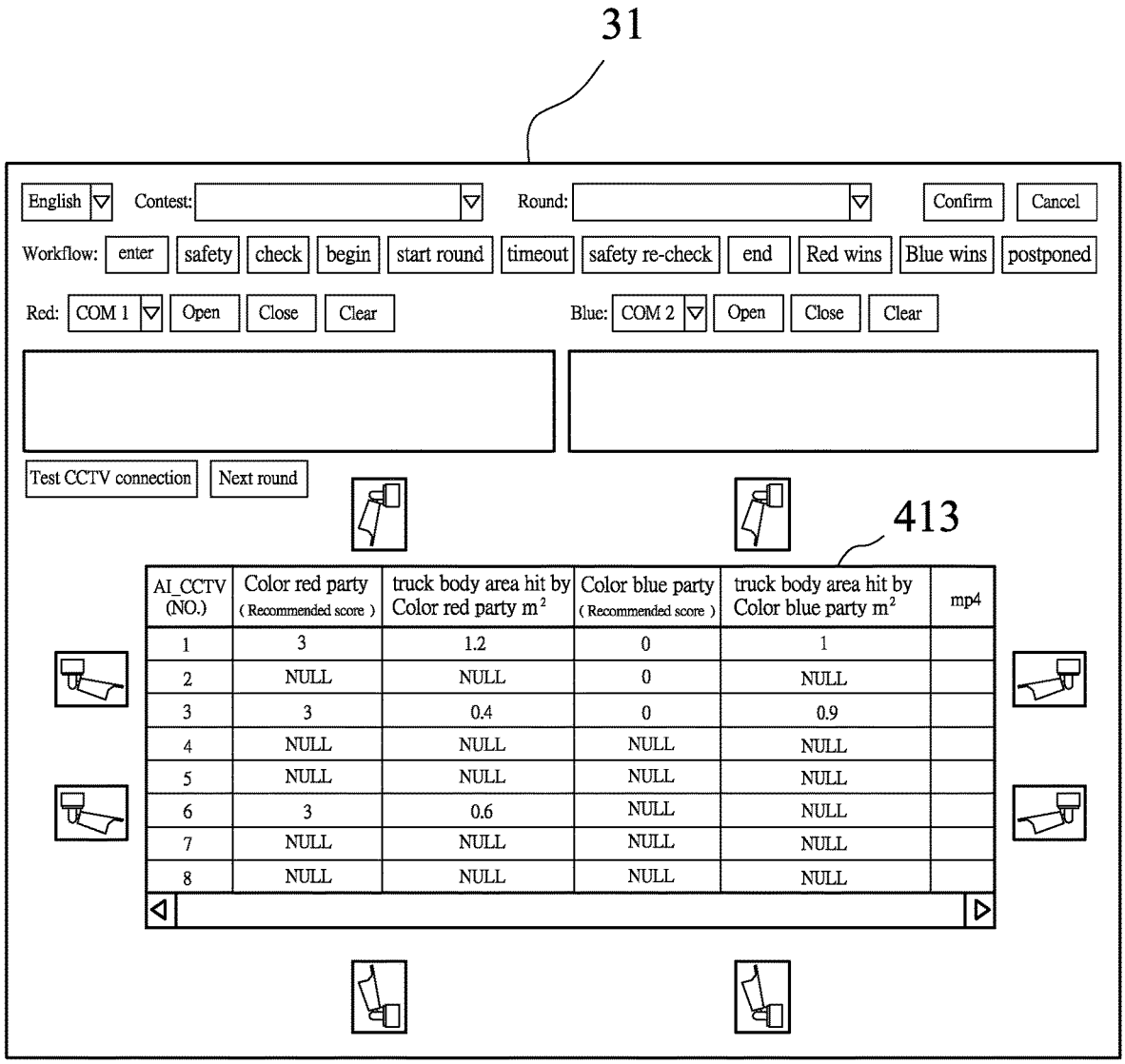
FIG. 9 a schematic diagram of the user interface of the tournament judging program device of the present invention.

The tournament judging program device 3 comprises at least one computer system with pre-installed programs, one display device, and at least one user interface 31, as shown in FIG. 9. The at least one user interface 31 provides inputs of the rounds of contestants. The tournament judging program device 3 receives and transmits the hit signals from at least two sensors 1, together with images of the hit areas and struck body areas, to a cloud device 4 on a real-time basis. In addition, the tournament judging program device 3 further comprises at least one handheld scoring device 33, wherein the handheld scoring device 33 allows the referee 34 to confirm and monitor the score recommendations of the cloud device 4, in order to produce the actual score of this round, which is the final actual scores of contestants of this round.

Figure 10:
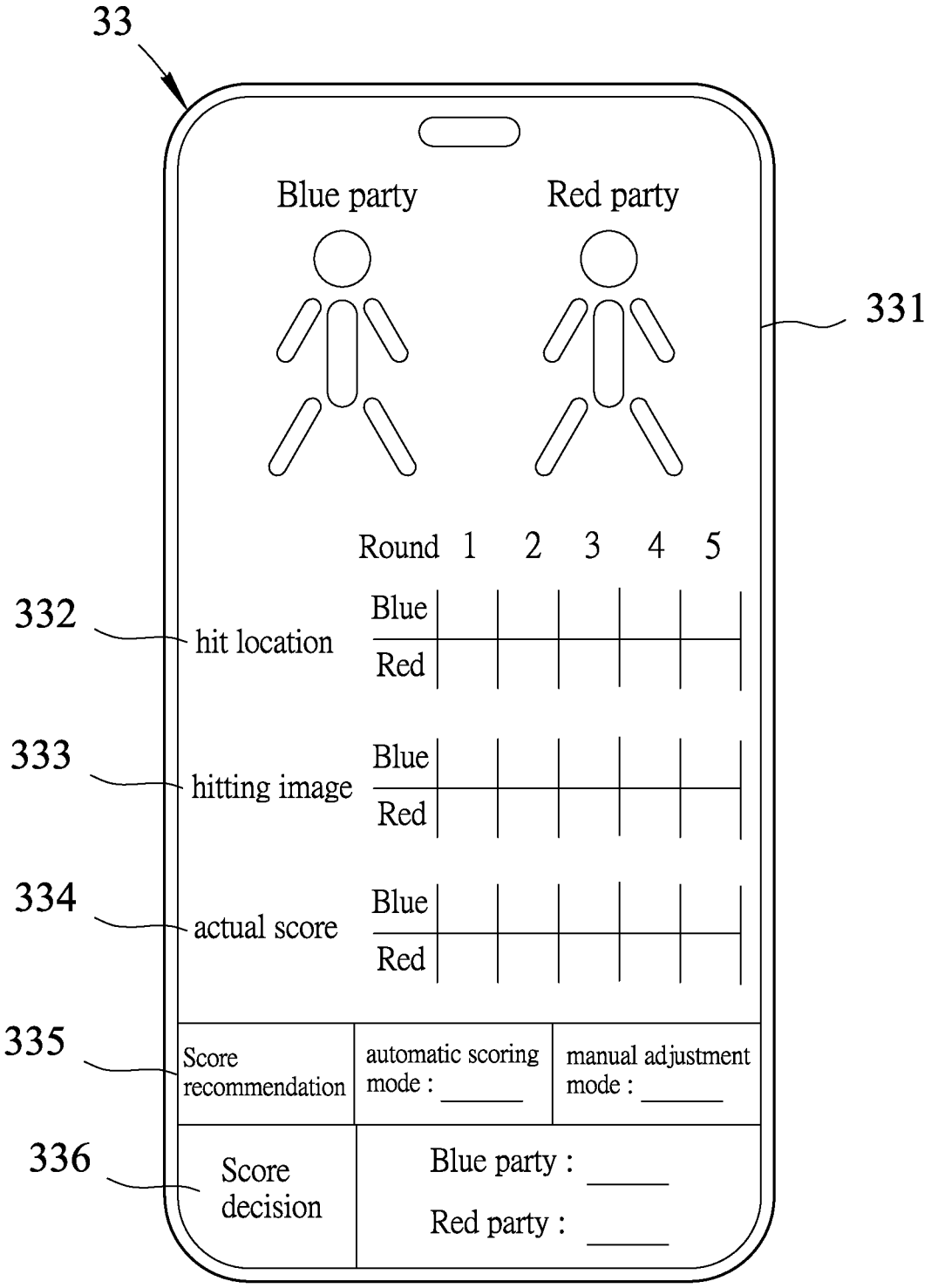
FIG. 10 a schematic diagram of the handheld scoring device of the present invention, and FIG. 11 a schematic diagram of the intelligent scoring decision flow chart for martial art contests of the present invention.

Please refer to FIG. 10. The handheld scoring device 33 can be a smart mobile phone or any electronic device that is connected with internet and has pre-installed programs, in other words, a smart scoring system that is connected to the internet through mobile communication or network connection, and can be connected with the cloud device 4, having an application software pre-installed in a memory unit therein, wherein the application software is executed by the microprocessor unit therein and the result is output to a display unit; a graphical interface 331 that appears on the display unit and provides a graphical interface for referees to operate, wherein the graphical interface displays, but not limited to, a hit location 332, a hitting image 333, an actual score 334, a score recommendation 335, a score decision 336 of contestants in every round of a contest. The score recommendation in the graphical interface 311 is further divided to an automatic scoring mode and a manual adjustment mode, whereas the score decision 336 is further divided to the actual scores of contestants separately.

The cloud device 4 comprises at least a server 41 and a database 42. The server 41 allows the contest creators to create contest information and is installed with a score recommendation module 411. The score recommendation module 411 conducts score recommendation based on the datasets provided by the tournament judging program device 3; the score recommendation is transmitted to the tournament judging program device 3 to be confirmed by the referee 34 as the actual score. The actual score confirmed by the referee 34 is then uploaded back to the cloud device 4 for real-time inquiry by audience or contestants.

Figure 11:
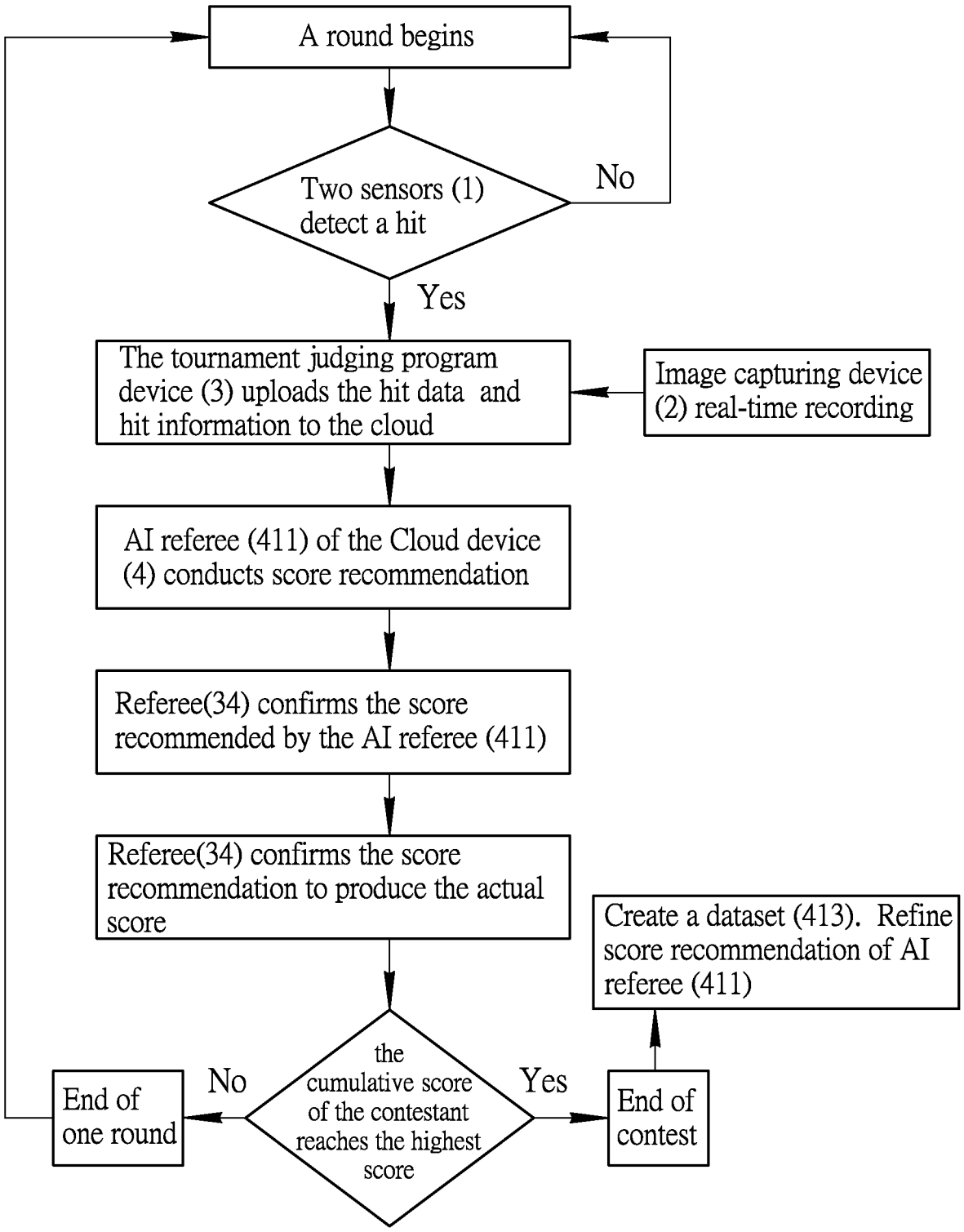

The present invention relates to an intelligent scoring method for martial art contests and the scoring device and system thereof, as shown in FIG. 11. During the martial art match in a round, the present invention uses the sensor 1 to activate a plurality of image capturing devices 2 to record images instantly, and simultaneously uploads signals of the sensors 1, hitting images, the recognized struck body area to the cloud device 4 through the tournament judging program device 3. Next, the AI referee (that is the score recommendation module 411) created in the cloud device 4 performs the score recommendations and the score recommendations are transmitted to the tournament judging device 3 at the fighting ring for the referee 34 to confirm and monitor as the actual score. Last, the confirmed actual score is transmitted again back to the cloud device 4 to complete a round of match. The next round of contest then begins until the cumulative score of the contestant reaches the highest score that ends the match of the round. All scores are available for real-time inquiry by audience or contestants. As a result, the present invention can deliver an automatic scoring operation and increase the efficiency of martial art contests. It is worth of mentioning that the contest data stored in the cloud device 4 can be used to establish another dataset 413 for the score recommendation module 411 (that is the AI referee) to conduct machine learning and improve the accuracy of the score recommendation.

What is claimed is:

1. An intelligent scoring system for martial arts contests, each of the martial arts contests including at least two real-world contestants, and each of the at least two real-world contestants having a corresponding fighting instrument, the system comprising:

at least two sensors, each of the at least two sensors being associated with a corresponding one of the at least two real-world contestants and being configured to detect and transmit data associated with a hit action in each round of a corresponding martial arts contest;

a plurality of image capturing devices, each of the plurality of image capturing devices being configured to capture images in real-time of each round of a corresponding martial arts contest;

an electronic device including a central processor subsystem and configured with mobile communication and internet access functionalities and being connected to the at least two sensors and the plurality of image capturing devices, the electronic device including at least a memory unit and a microprocessor unit both connected to the central processor subsystem and having an application software pre-installed in the memory unit, wherein the application software is executed by the microprocessor unit, the electronic device receiving the data associated with a hit action from the at least two sensors and the captured images of each round of a corresponding martial arts contest from the plurality of image capturing devices, and the central processor subsystem responsively generating data identifying a hit area from a corresponding one of the captured images corresponding in time to a respective hit action, and the central processor subsystem, further, responsively analyzing the data identifying the hit area for generating data identifying a struck body area of a corresponding one of the at least two real-world contestants;

a tournament judging program subsystem coupled to the electronic device, the at least two sensors, and the plurality of image capturing devices, the tournament judging program subsystem receiving the data associated with a hit action, the data identifying a hit area, and the data identifying a struck body area, for being collated together to be subsequently uploaded, the tournament judging program subsystem, further, including a first input/output graphical interface for referees to operate on, the first input/output graphical interface being operable by a referee via an input/output unit of a corresponding electronic gadget of the referee, wherein the first input/output graphical interface is configured to at least display a hit location, a hitting image, an actual score for a round of a martial arts contest, a score recommendation for a round of a martial arts contest, and a score decision of the at least two real-world contestants in every round of a martial arts contest; and a cloud device subsystem coupled to the tournament judging program subsystem and receiving the collated data associated with a hit action, the data identifying a hit area, and the data identifying a struck body area, the cloud device subsystem including a database and a server processor having a score recommendation module, wherein the score recommendation module generates the score recommendation for a corresponding round of a respective martial arts contest for being transmitted to the tournament judging program subsystem based on the collated data associated with a hit action, the data identifying a hit area, and the data identifying a struck body area, and a referee associated with a corresponding martial arts contest reviews and selectively adjusts the score recommendation for the round of the marital arts contest via the tournament judging program subsystem to thereby generate an actual score of the round of the martial arts contest to be transmitted back to the cloud device subsystem;

wherein the score recommendation module generates a usage module using machine learning for generating the score recommendation for each round of a corresponding martial arts contest for each of the at least two real-world contestants, wherein a dataset and a training model are initially generated by the score recommendation module and the training model is trained by the dataset for further generating an evaluation model, the dataset including data indicative of a round in a previous martial arts contest, data indicative of a score recommendation for a round of a previous martial arts contest, data indicative of a struck body area of a real-world contestant in a previous martial arts contest, and data indicative of an actual score for a round of a previous martial arts contest determined by a corresponding referee, and the dataset including the data indicative of a round, a score recommendation, and a struck body area, with respect to previous martial arts contests being selected as computational characteristics to generate the score recommendation for each round of a corresponding martial arts contest, and the dataset including the data indicative of an actual score determined by a corresponding referee with respect to previous martial arts contests being selected to further train the training model, wherein subsequent to the score recommendation module selectively verifying the evaluation model, the evaluation model is selected as the usage model by the score recommendation module, and wherein the training model, the evaluation model, and the usage model, are generated using a matrix factorization and the dataset, and a score matrix is generated based on the dataset for being input into the matrix factorization to output an explicit data and an implicit data, wherein the explicit data is indicative of an actual score of a corresponding martial arts contest for each of the at least two real-world contestants.

2. The intelligent scoring system for martial arts contests as claimed in claim 1, wherein the score recommendation for a round of a martial arts contest includes an automatic scoring mode and a manual adjustment mode, and wherein the score decision of the at least two real-world contestants in every round of a martial arts contest includes generating the actual score for each of the at least two real-world contestants for a round of a martial arts contest separately.

3. The intelligent scoring system for martial arts contests as claimed in claim 1, wherein each of the at least two sensors is either of worn by a corresponding one of the at least two real-world contestants or is attached to a respective fighting instrument associated with a corresponding one of the at least two real-world contestants; and wherein the plurality of image capturing devices are installed in areas surrounding a fighting ring in which the at least two real-world contestants are located.

4. The intelligent scoring system for martial arts contests as claimed in claim 1, wherein the input/output unit of a corresponding electronic gadget of a respective referee associated with the first input/output graphical interface of the tournament judging program subsystem is a handheld scoring device, wherein the referee operates the handheld scoring device to selectively adjust the score recommendation for each round of a corresponding marital arts contest.

5. The intelligent scoring system for martial arts contests as claimed in claim 3, wherein the at least two sensors are separately attached to a respective fighting instrument associated with a corresponding one of the at least two real-world contestants, and thereby the martial arts contests is applicable to include polearm, western fencing, martial arts, wrestling, taekwondo, or spearing fight contests.

6. An intelligent scoring method for martial arts contests each of the martial arts contests including at least two real-world contestants, and each of the at least two real-world contestants having a corresponding fighting instrument, the method comprising:

either of wearing a martial arts contest sensor by each of the at least two real-world contestants or placing a martial arts contest sensor on a corresponding fighting instrument of each of the respective at least two real-world contestants, thereby each martial arts contest sensor is associated with a corresponding one of the at least two real-world contestants;

detecting and transmitting data associated with a hit action in each round of a martial arts contest by a corresponding martial arts contest sensor with respect to at least one of the at least two real-world contestants being hit to a tournament judging program subsystem via wireless communication;

capturing images of each round of a corresponding martial arts contest in real-time by a plurality of image capturing devices, and identifying a hit area from the captured images in real-time for further generating data in real-time identifying a struck body area of a corresponding one of the at least two real-world contestants from a respective hit area, and further transmitting the data identifying the struck body area to the tournament judging program subsystem in real-time;

collating the data associated with a hit action in each round of a martial arts contest with the data identifying the struck body area from each round of a corresponding martial arts contest by the tournament judging program subsystem, and transmitting the collated data to a cloud device subsystem;

conducting cloud-based intelligent scoring by a score recommendation module of a server processor of the cloud device subsystem, wherein the score recommendation module generates a score recommendation for a round of a martial arts contest based on the collated data associated with the hit action in the round of the martial arts contest and the data identifying the struck body area from the round of the martial arts contest, and further transmitting the score recommendation for each round of a corresponding martial arts contest to the tournament judging program subsystem; and displaying the score recommendation for each round of a corresponding martial arts contest by the tournament judging program subsystem for being reviewed by a referee associated with a corresponding martial arts contest, and selectively adjusting the score recommendation for each round of a corresponding martial arts contest by the respective referee via the tournament judging program subsystem for generating an actual score for each round of a corresponding martial arts contest, and further transmitting the actual score for each round of a corresponding martial arts contest back to the cloud device subsystem for inquiry by an audience or by the at least two real-world contestants;

wherein the score recommendation module generates a usage model using machine learning for generating the score recommendation for each round of a corresponding martial arts contest for each of the at least two real-world contestants, wherein a dataset and a training model are initially generated by the score recommendation module and the training model is trained by the dataset for further generating an evaluation model, the dataset including data indicative of a round in a previous martial arts contest, data indicative of a score recommendation for a round of a previous martial arts contest, data indicative of a struck body area of a real-world contestant in a previous martial arts contest, and data indicative of an actual score for a round of a previous martial arts contest determined by a corresponding referee, and the dataset including the data indicative of a round, a score recommendation, and a struck body area, with respect to previous martial arts contests being selected as computational characteristics to generate the score recommendation for each round of a corresponding martial arts contest, and the dataset including the data indicative of an actual score determined by a corresponding referee with respect to previous martial arts contests being selected to further train the training model, wherein subsequent to the score recommendation module selectively verifying the evaluation model, the evaluation model is selected as the usage model by the score recommendation module, and wherein the training model, the evaluation model, and the usage model, are generated using a matrix factorization and the dataset, and a score matrix is generated based on the dataset for being input into the matrix factorization to output an explicit data and an implicit data, wherein the explicit data is indicative of an actual score of a corresponding martial arts contest for each of the at least two real-world contestants.

7. An intelligent scoring device for martial arts contests, each of the martial arts contests including at least two real-world contestants, and each of the at least two real-world contestants having a corresponding fighting instrument, the device comprising:

a physical electromechanical instrument configured with at least mobile communication and internet access functionalities and including a central processor subsystem, the central processor subsystem being connected to a memory unit, a display unit, and a microprocessor unit, of the physical electromechanical instrument, wherein an application software is preinstalled in the memory unit for being executed by the microprocessor unit and to output a result by the display unit, the central processor subsystem being configured to receive data associated with a hit action in each round of a martial arts contest, and the central processor subsystem being configured to receive images in real-time of each round of a martial arts contest, wherein the central processor subsystem generates data identifying a hit area from a respective one of the captured images corresponding in time to the hit action for further generating data identifying a struck body area of a corresponding one of the at least two real-world contestants from a respective hit area;

wherein the physical electromechanical instrument, further, includes a tournament judging program subsystem connected to the central processor subsystem, the tournament judging program subsystem receiving in real-time and collating the data associated with a hit action and the data identifying a struck body area for transmission to a remote cloud server in real-time, the tournament judging program subsystem, further, including a first input/output graphical interface and a second input/output graphical interface, wherein the first input/output graphical interface is operable by a referee associated with a corresponding martial arts contest and is connected to the display unit for at least displaying on the display unit a hit location, a hitting image, an actual score of a round of a contest, a score recommendation for a round of a contest, and a score decision of the at least two real-world contestants in every round of a contest, wherein a user of a corresponding physical electromechanical instrument inputs data indicative of a round of a corresponding martial arts contest via the second input/output graphical interface; and wherein the remote cloud server is coupled to the tournament judging program subsystem for receiving the collated data associated with a hit action and identification of a struck body area, the remote cloud server including a database and a server processor having a score recommendation module, wherein the score recommendation module generates the score recommendation for a round of a corresponding martial arts contest for being transmitted to the tournament judging program subsystem based on the collated data associated with a hit action and identification of a struck body area, wherein a referee associated with a corresponding martial arts contest reviews the score recommendation of the round of the contest displayed by the display unit and selectively adjusts the score recommendation via the first input/output graphical interface for generating the actual score of the round of the contest for being transmitted back to the remote cloud server by the tournament judging program subsystem;

wherein the score recommendation module generates a usage model using machine learning for generating the score recommendation for each round of a corresponding martial arts contest for each of the at least two real-world contestants, wherein a dataset and a training model are initially generated by the score recommendation module and the training model is trained by the dataset for further generating an evaluation model, the dataset including data indicative of a round in a previous martial arts contest, data indicative of a score recommendation for a round of a previous martial arts contest, data indicative of a struck body area of a real-world contestant in a previous martial arts contest, and data indicative of an actual score for a round of a previous martial arts contest determined by a corresponding referee, and the dataset including the data indicative of a round, a score recommendation, and a struck body area, with respect to previous martial arts contests being selected as computational characteristics to generate the score recommendation for each round of a corresponding martial arts contest, and the dataset including the data indicative of an actual score determined by a corresponding referee with respect to previous martial arts contests being selected to further train the training model, wherein subsequent to the score recommendation module selectively verifying the evaluation model, the evaluation model is selected as the usage model by the score recommendation module, and wherein the training model, the evaluation model, and the usage model, are generated using a matrix factorization and the dataset, and a score matrix is generated based on the dataset for being input into the matrix factorization to output an explicit data and an implicit data, wherein the explicit data is indicative of an actual score of a corresponding martial arts contest for each of the at least two real-world contestants.

8. The intelligent scoring device for martial arts contests as claimed in claim 7, wherein the score recommendation for a round of a martial arts contest includes an automatic scoring mode and a manual adjustment mode, and wherein the score decision of the at least two real-world contestants in every round of a martial arts contest includes generating the actual score for each of the at least two real-world contestants for a round of a martial arts contest separately.

* * * * *